United States Patent [19]

Meyer et al.

[11] 4,130,401

[45] Dec. 19, 1978

[54] COMBUSTIBLE AND MOBILE FUEL SLURRY AND METHOD OF PREPARING SAME

[75] Inventors: Wilfred C. Meyer; Richard R. Klimpel, both of Midland, Mich.

[73] Assignee: The Dow Chemical Company, Midland, Mich.

[21] Appl. No.: 866,305

[22] Filed: Jan. 3, 1978

[51] Int. Cl.[2] ..... C10L 1/32

[52] U.S. Cl. ..... 44/51

[58] Field of Search ..... 44/51, 71; 252/308, 252/309

[56] References Cited

U.S. PATENT DOCUMENTS

| | | | |
|---|---|---|---|
| 2,430,085 | 11/1947 | Spencer et al. | 44/51 |
| 3,241,505 | 3/1966 | Long et al. | 44/51 |
| 3,458,294 | 7/1969 | Nixon et al. | 44/51 |
| 3,709,747 | 1/1973 | Nixon et al. | 44/51 |

OTHER PUBLICATIONS

"Non-Ionic Surfactants", Calculation of HLB Values, May 1955, pp. 26–28.

*Primary Examiner*—Winston A. Douglas
*Assistant Examiner*—Y. Harris-Smith
*Attorney, Agent, or Firm*—Lester J. Dankert; Thomas R. Wills

[57] ABSTRACT

Combustible fuel slurries are prepared by admixing solid particulate carbonaceous material, liquid hydrocarbon fuel such as gasoline, fuel oil, and the like, a polar liquid flocculating third phase, and a wetting agent having an HLB value in the range of about 6.5 to about 10 and which is soluble in the third phase. Such slurries are mobile and readily processible in conventional fuel oil transporting, storage, and burning equipment.

5 Claims, No Drawings

COMBUSTIBLE AND MOBILE FUEL SLURRY AND METHOD OF PREPARING SAME

BACKGROUND OF THE INVENTION

The present invention relates in general to combustible fuel slurries of solid carbonaceous material in liquid hydrocarbon fuel, and more particularly relates to the modification of such slurries to improve their utility and stability.

It is well known that in certain instances an atomizable liquid fuel offers a marked advantage over a solid fuel. However, the depletion of world liquid fuel reserves threatens the continued use of equipment adapted for such atomizable fuel. In addition, a comparative scarcity of certain liquid fuels in many lands coupled with an abundance of solid carbonaceous fuel has led to experimentation in extending the liquid fuels with solid fuels. Accordingly, attempts have been made to suspend the cheaper and more plentiful solid carbonaceous materials in liquid fuels in such fashion that the slurries could be used in place of the liquid fuels without extensive modification of the conventional equipment used to handle and burn the liquid fuels. Unless such slurries are treated in some fashion, however, the carbonaceous material will settle out of the slurry over time and form a hard, compact cake at the bottom of the slurry-containing vessel, thereby limiting the utility of the composite fuels.

Many approaches have been suggested to improve the stability and functionality of such composite fuels. One method is simply to grind carbonaceous material such as coal to practically colloidal size before adding it to the liquid fuel. The smallness of size inherently reduces sedimentation. However, this method is cost prohibitive because of the extensive milling required to reduce the particle size to that level.

It was also discovered that the composite fuel could be stabilized by the addition of coal distillates, such as tars and middle fractions, and subjecting the slurry to special heat treatment below the flash point of the mixture. This is inherently a very expensive batch process.

Other materials have also been added to the slurries in attempts to prevent settling of larger than colloidal size particles. Some processes have used fillers such as wood pulp, dust, and waste from starch, flour, and corn factories and others have used substantial amounts of colloidal size particles of coal to stabilize the non-colloidal particles.

Others have used emulsifiers which have generally required, in addition, substantial amounts of water which undesirably reduces the heating value of the fuel and has the potential of corroding the equipment used in handling and burning the slurry. Furthermore, emulsions are easily broken by heating or mechanical agitation and they are generally useful for stabilizing slurries containing only small amounts of coal.

Finally, still others have used additives to thicken and/or gel the composite fuel to prevent sedimentation of the larger coal particles. Casein, gelation, rubber, and soaps have been used to gel the hydrocarbon. Generally, however, these thickening agents have been employed in such quantity that they undesirably increase the viscosity and substantially decrease the number of uses for the composite fuel.

Accordingly, it would be desirable if a slurry of solid particulate carbonaceous material and liquid hydrocarbon fuel could be treated or modified so as to improve its stability and utility without requiring extensive grinding of the carbonaceous material, addition of excessive amounts of water, or complete thickening of the slurry.

SUMMARY OF THE INVENTION

The present invention provides a combustible and mobile fuel slurry comprising solid particulate carbonaceous material, liquid hydrocarbon fuel, a polar liquid flocculating third phase, e.g., water, and a wetting agent having an HLB value in the range of about 6.5 to about 10 and which is soluble in the third phase. In one aspect the invention relates to such slurries as new compositions of matter, and in another aspect relates to the process for preparing such slurries.

Slurries of the present invention have improved stability and utility compared to unmodified slurries, without requiring extensive grinding of the carbonaceous material, addition of excessive amounts of water, or complete thickening of the slurry. The combination of flocculating third phase and wetting agent improves the slurry by deterring settling of the carbonaceous material as well as by interrupting the packing efficiency of any sediment that forms, thereby preventing the formation of a hard, compact cake at the bottom of the slurry-containing vessel. Consequently, the goal of complete slurry stability is no longer a concern as it was in the prior art, since any sediment that forms can be readily redispersed with agitation. Thus, a tremendous ease of processability is gained by the present invention without substantial loss of heating value.

DETAILED DESCRIPTION AND EMBODIMENTS

The combustible fuel slurries of the present invention are principally comprised of solid particulate carbonaceous material and liquid hydrocarbon fuel. As used herein, "solid particulate carbonaceous material" shall include such materials as bituminous and anthracite coals, coke, petroleum coke, lignite, charcoal, peat, and combinations thereof. "Liquid hydrocarbon fuel" as used herein shall include crude and refined hydrocarbon based oils, including but not limiting to petroleum fuel oils, heavy residual oils and crude oils, and the like.

It is preferred that the particulate carbonaceous material employed in the slurry be powdered or pulverized to a size that will enable at least about 50% to pass through a 200 mesh sieve or screen. Such screening produces particles which are relatively small, yet considerably larger than colloidal size. Although the cost of milling carbonaceous material to a size smaller than that suggested increases dramatically with further grinding, such grinding may be desirable for some users since a slight increase in stability can be obtained by using smaller particles, as shown in the Examples. The upper limit of coal size will be determined by the use of the slurry, e.g., the size that will pass through a burning apparatus.

The amount of particulate carbonaceous material which is added to the liquid hydrocarbon fuel can vary depending upon the user's requirement. For most users, about 5 weight percent of carbonaceous material or less is not normally economically interesting, and when about 60 weight percent or more of carbonaceous material is added the slurry begins to show undesirable flow characteristics. These limits are provided for illustration and guidance, and need not be strictly applied.

The term "polar liquid flocculating third phase" as used herein refers to those polar liquids which have the capacity to induce flocculation of the solid carbonaceous material within the slurry. Examples of suitable liquids are water, formamide, dimethyl acetamide, and the like. Of these, water is the preferred and most effective flocculating agent. If a water-free system is desired, however, formamide is the preferred substitute. In an unflocculated slurry of coal and oil without stabilizing additives, the coal particles will settle out and form a hard, tightly-packed sediment which is extremely difficult to redisperse. If the coal particles are induced to flocculate — with water, for example, — the slurry will form a more loosely packed sediment which is readily redispersible. It is believed that the flocculated particles form an open network structure entraining the liquid hydrocarbon fuel within, thus interrupting the packing efficiency of any sediment that is deposited by the slurry. consequently, it is advantageous that the third phase be immiscible with the liquid fuel, since the interfacial tension beween the liquid hydrocarbon fuel and the third phase provides the driving force for this flocculated or open network structure.

The wetting agents used in the present invention are additives which are known to lower the surface tension of a liquid, such as water, so that the liquid is better able to wet the surface of a solid, such as coal. In order that the third phase can more efficiently wet the surface of the solid particles, it is advantageous that the wetting agent be more soluble in the third phase of the slurry than in the liquid hydrocarbon fuel. It is also desirable that the wetting agent does not entirely eliminate the interfacial forces between the third phase and the liquid hydrocarbon fuel.

It is convenient to describe the class of suitable wetting agents by reference to the scale of hydrophilelipophile balance (HLB) known to the surfactant art. Preferably, the wetting agents of the present invention have an HLB value in the range of about 6.5 to about 10. The particular wetting agents that satisfy the aforementioned criteria of HLB value and solubility in the third phase are numerous; to list them all would be impractical and unduly limiting, since new wetting agents are constantly being discovered. Examples of suitable wetting agents are the polypropylene glycol monoethers such as Dowfroth® 250 of the Dow Chemical Company; the polyoxyalkylene derivatives of propylene glycol such as Pluronic® L-72 of Wyandotte Chemical Company; and polypropylene glycols such as the Polyglycol P series of The Dow Chemical Company. Generally, the lower alcohols, such as pentanol, isopropanol, and the like, are not suitable as wetting agents in the present invention. An extensive list of surfactants together with their HLB values is given in Kirk-Othmer Encyclopedia of Chemical Technology, second edition, vol. 8, pages 128–130 (1965). From this list it is possible to select those that either alone or in admixture will give an HLB value suitable for use in the present invention.

The amount of third phase plus wetting agent used in the present invention can range from about 1 to about 15 wt. percent of the final slurry; most beneficially, the amount will range from about 4 to about 6 wt. percent. The amount of wetting agent can range from about 0.5 to about 15 wt. percent, based on the weight of the third phase plus wetting agent; most beneficially, it will range from about 2 to about 5 wt. percent. The resulting slurry of the present invention remains essentially mobile since ther is no requirement that the liquid hydrocarbon fuel be gelled. The primary effect of the third phase and wetting agent is to reduce settling and interact with the sediment phase of the slurry to render it readily redispersible.

Composite fuels in accordance with the present invention are readily prepared by adding a mixture of the third phase and wetting agent to a slurry of the liquid hydrocarbon fuel and solid carbonaceous material. The slurry is then stirred or otherwise agitated until the solid particles are sufficiently wetted with the third phase. Alternatively, the solid particles are prewet with a mixture of third phase and wetting agent and then added to the liquid fuel to form the slurry. In another embodiment, the liquid fuel, wetting agent, and third phase are combined and pre-mixed before the solid particles are added to form the slurry. If desired, the admixing of the slurry may be carried out at elevated temperatures to hasten thorough mixing thereof, e.g., when a viscous liquid fuel is used. Other variations and combinations are possible.

The following specific examples illustrate the invention but are not to be taken as limiting its scope. Parts and percentages are by weight unless otherwise indicated or required by context.

EXAMPLE 1

To test the flocculating effect of certain additives, slurry samples were prepared by admixing 40% cleaned bituminous coal of medium volatility, with 80% passing through a 325 mesh screen, and 60% (less the weight of any additives) #2 fuel oil having a viscosity of 3 cp at room temperature. Water or water containing an additive was added to some samples, and the samples were shaken to ensure complete mixing. After the samples were mixed, they were compared for yield value. The appearance of an immediate yield value before settling takes place indicates the extent of particle-to-particle interaction, i.e., the degree of flocculation, within the slurry. Yield values were measured with a Rotavisco RV-3 with MVI cup and bob on the K-3 scale. Torque readings were converted to dynes/cm$^2$ using instrument conversion factors.

After being stored undisturbed for a number of days, e.g., 50 days or longer, at room temperature, the samples were then qualitatively compared for sediment redispersibility by stirring the sediments with a spatula.

The results in Table 1 show that the addition of water alone to a coal/oil slurry will induce flocculation and beneficially modify any sediment that forms. The results also show that the addition of a wetting agent increases the flocculating efficiency of the water, thereby reducing the amount of water required to give the desired results. Consequently, the loss of heating value owing to excess amounts of water is eliminated. The sediment formed from the slurry containing water plus a wetting agent is readily redispersed, signifying the ease of processability gained by the present invention.

TABLE I

| Sample | Additive(3) | Slurry Yield Value (Dynes/cm$^2$) | Sediment Character |
|---|---|---|---|
| 1.1(2) | None | 0 | Very hard |
| 1.2(2) | 2% Water | 16 | Paste |
| 1.3(2) | 6% Water | 35 | Paste |
| 1.4(2) | 10% Water | 40 | Paste |
| 1.5 | 2% Water containing | 38 | Loose Gel |

TABLE I-continued

| Sample | Additive[3] | Slurry Yield Value (Dynes/cm$^2$) | Sediment Character |
|---|---|---|---|
| | 1% surfactant[1] | | |

Notes:
[1]Pluronic® L-72 polyoxyalkylene derivative of propylene glycol from Wyandotte Chemical Company.
[2]Not an example of the invention.
[3]Additive percentages based on total slurry weight.

EXAMPLE 2

In a series of experiments, slurry samples were prepared by admixing 40 parts of the coal used in Example 1 and 60 parts (less any additives) of the fuel oil used in Example 1. Two parts (less the weight of any wetting agents) water or water containing a wetting agent were then added to some samples, and the samples were agitated by shaking to ensure uniform mixing. The samples were allowed to stand undisturbed for a number of days, e.g., 32 days or longer, after which time the samples were compared for percent settling reduction. "Percent settling reduction" is defined as $$100 \times (V_B - V_S)/V_B$$

where $V_B$ is the volume of free oil appearing above any sediment that forms in the blank or control slurry sample (containing no water or additives), and $V_S$ is the volume of oil appearing above any sediment that forms in the slurry sample being tested. By definition, then, the blank or control sample shows no reduction in settling, and a slurry sample in which no free oil forms above a sediment shows 100% settling reduction.

The results of these experiments, as shown in Table II, demonstrate the effectiveness of different wetting agents. It can be seen from Samples 2.3 and 2.4 that the alcoholic additives actually reduce the effectiveness of water as a flocculating third phase. Consequently, such additives are not suitable for use as wetting agents in the practice of this invention. Also, wetting agents having an HLB value greater than about 10 are not suitable for the present invention, as shown by Sample 2.5.

TABLE II

| Sample | Additives | Wetting Agent HLB Value | Percent Settling Reduction |
|---|---|---|---|
| 2.1[1] | None | None | 0 |
| 2.2[1] | Water | None | 59 |
| 2.3[1] | Water containing 5% isopropanol | 7.5 | 38 |
| 2.4[1] | Water containing 2% pentanol | 6.5 | 56 |
| 2.5[1] | Water containing 5% PLURONIC L-64[2] | 15 | 59 |
| 2.6 | Water containing 2% Polyglycol P-400[4] | 8.0 | 65 |
| 2.7 | Water containing 2% Polyglycol P-1200[4] | 7.0 | 65 |
| 2.8 | Water containing 1% DOWFROTH 250[3] | 7.9 | 66 |
| 2.9 | Water containing 1% PLURONIC L-72[2] | 6.5 | 73 |

Notes:
[1]Not an example of the invention.
[2]Trademark of Wyandotte Chemical Company; a polyoxyalkylene derivative of propylene glycol.
[3]Trademark of The Dow Chemical Company; a polypropylene glycol monoether.
[4]Product of The Dow Chemical Company; a polypropylene glycol.

EXAMPLE 3

Slurry samples were prepared by admixing 30 parts of the coal used in Example 1 and 70 parts (less any additives) of the fuel oil used in Example 1. Different flocculating liquids, and liquids containing a wetting agent, were then added to the samples, and the mixtures were shaken for 30 seconds. After allowing the samples to stand for 3 days, they were compared for percent settling reduction.

The results, as shown in Table III, demonstrate the comparative effectiveness of formamide and water as a flocculating third phase. Additionally, these results show that the effectiveness of formamide can be improved by incorporating a wetting agent in the slurry mixture.

TABLE III

| Sample | Additives | Percent Settling Reduction |
|---|---|---|
| 3.1[1] | None | 0 |
| 3.2[1] | 6 parts formamide | 41 |
| 3.3 | 6 parts formamide containing 2% DOWFROTH 250[2] | 52 |
| 3.4[1] | 6 parts water | 57 |
| 3.5 | 6 parts water containing 2% DOWFROTH 250[2] | 65 |

Notes:
[1]Not an example of the invention.
[2]Trademark of The Dow Chemical Company; a polypropylene glycol monoether.

EXAMPLE 4

A number of slurry samples were prepared by admixing 40 parts of the coal used in Example 1, and 60 parts (less the weight of any additives) of the fuel oil used in Example 1. Water, and water containing varying porportions of DOWFROTH 250 polypropylene glycol monether, were added and mixed with some of the slurry samples. The samples were allowed to rest, and then compared for percent settling reduction.

The results in Table IV show that in the slurry samples of this Example there is no appreciable advantage to be gained by adding more than about 2 weight percent of the wetting agent, based on the weight of flocculating third phase plus wetting agent.

TABLE IV

| Sample | Additives | Percent Settling Reduction |
|---|---|---|
| 4.1[1] | None | 0 |
| 4.2[1] | 6 parts water | 66 |
| 4.3 | 6 parts water containing 1% wetting agent | 74 |
| 4.4 | 6 parts water containing 2% wetting agent | 83 |
| 4.5 | 6 parts water containing 5% wetting agent | 83 |
| 4.6 | 6 parts water containing 12.5% wetting agent | 85 |

Notes:
[1]Not an example of the invention.

EXAMPLE 5

A number of slurry samples were prepared by admixing different proportions of the coal and fuel oil used in Example 1. Water, and water containing DOWFROTH 250 polypropylene glycol monoether, were added and mixed with some samples. The samples were allowed to stand undisturbed for at least 1 day, and then compared for percent settling reduction.

The results in Table V show that a greater degree of settling reduction can be achieved with the same amount of additives when a greater relative proportion of coal is present in the slurry.

TABLE V

| Sample | Slurry Composition (coal:oil)[1] | Additives | Percent Settling Reduction |
|---|---|---|---|
| 5.1[2] | 30:70 | None | 0 |
| 5.2[2] | 30:70 | 6 parts water | 57 |
| 5.3 | 30:70 | 6 parts water containing 2% wetting agent | 65 |
| 5.4[2] | 40:60 | None | 0 |
| 5.5[2] | 40:60 | 6 parts water | 66 |
| 5.6 | 40:60 | 6 parts water containing 2% wetting agent | 83 |

Notes:
[1]Parts by weight.
[2]Not an example of the invention.

EXAMPLE 6

Two slurry samples were prepared by admixing 50 parts coal, 50 parts oil, and 6 parts water containing 12.5 weight percent DOWFROTH 250 polypropylene glycol monoether. In one sammple, the coal and fuel oil were the same as those in Example 1. In the other sample, the coal and oil were the same as those in Example 1 but the coal was pulverized so that about 80 percent passed through a 200 mesh scren, instead of 80 percent through a 325 mesh screen. After standing for 60 days, the samples were compared for percent settling reduction. The samle containing the finer coal (80 percent minus 325 mesh) showed a 100 percent settling reduction, whereas the sample containing the coarser coal (80 percent minus 200 mesh) showed only an 81 percent settling reduction. This demonstrates the advantage of using coal which has been subjected to further grinding. That advantage, however, must be balanced against the cost of such grinding.

What is claimed is:

1. An improved mobile and combustible fuel slurry comprising solid particulate carbonaceous material, liquid hydrocarbon fuel, a polar liquid flocculating third phase, and a wetting agent soluble in the third phase, wherein the wetting agent has an HLB value in the range of about 6.5 to about 10.

2. The slurry of claim 1 wherein the amount of solid carbonaceous material ranges from about 5 to about 60 weight percent of the slurry.

3. The slurry of claim 1 wherein the amount of flocculating third phase and wetting agent ranges from about 1 to about 15 weight percent of the total slurry weight and the amount of wetting agent ranges from about 0.5 to about 15 weight percent based on the weight of the flocculating third phase and wetting agent, wherein the flocculating third phase is water and the wetting agent is at least one of the group consisting of polypropylene glycols, polyoxyalkylene derivatives of propylene glycol, and propylene glycol monoethers.

4. The slurry of claim 1 wherein the flocculating third phase is formamide.

5. A process for preparing a mobile and combustible fuel slurry which comprises admixing solid particulate carbonaceous material, liquid hydrocarbon fuel, a polar liquid flocculating third phase, and a wetting agent soluble in the third phase, wherein the wetting agent has an HLB value in the range of about 6.5 to about 10.

* * * * *